United States Patent [19]

Takada et al.

[11] Patent Number: 4,571,193

[45] Date of Patent: Feb. 18, 1986

[54] OUTBOARD MOTOR

[75] Inventors: Yukimitsu Takada, Kosai; Hiroshi Karada, Shizuoka, both of Japan

[73] Assignee: Sanshin Kogyo Kabushiki Kaisha, Hamamatsu, Japan

[21] Appl. No.: 485,037

[22] Filed: Apr. 14, 1983

[30] Foreign Application Priority Data

Apr. 24, 1982 [JP] Japan ..... 57-68909

[51] Int. Cl.[4] ..... B63H 21/24

[52] U.S. Cl. ..... 440/77

[58] Field of Search ..... 440/77, 88, 89; 181/229; 123/195 P; 114/211, 212

[56] References Cited

U.S. PATENT DOCUMENTS 3,195,530 7/1965 Heidner ..... 440/77

3,610,198 10/1971 Alexandrowicz ..... 440/77

4,403,971 9/1983 Kobayashi et al. ..... 440/88

*Primary Examiner*—S. D. Basinger

*Assistant Examiner*—Jesûs D. Sotelo

*Attorney, Agent, or Firm*—Ernest A. Beutler

[57] ABSTRACT

Two embodiments of improved cowling arrangements for an outboard motor that ducts inlet air to the motor without restricting the air flow and while at the same time insuring against water separation. In each embodiment, the cowling member includes both a rearwardly disposed air inlet opening and a sidewardly disposed air inlet opening. The sidewardly disposed air inlet opening is positioned so as to permit drainage of water from the air inlet when the motor is tilted up. In one embodiment of the invention, the sidewardly disposed air inlet openings are positioned at the forwardmost edge of a air inlet chamber so that water can drain from the air inlet when the motor is tilted up without any accumulation.

17 Claims, 7 Drawing Figures

OUTBOARD MOTOR

BACKGROUND OF THE INVENTION

This invention relates to an outboard motor and more particularly to an improved cowling construction for outboard motors.

As is well known, it is the normal practice to enclose the engine of an outboard motor within an outer protective cowling. The protective cowling serves several purposes, the prime of which are the protection of the engine and its associated components from the elements and to improve the appearance of the motor. Since the engine is substantially concealed and contained with the protective cowling, it is necessary to provide some arrangement wherein the inlet air may be delivered to the engine induction system through the cowling. The air inlet should be of such a nature that it does not substantially restrict the intake air flow, but, at the same time, it should prevent the entry of water from either rain or splashes from entering the engine induction system. In order to achieve these inconsistent functions, it has been proposed to provide a rear air inlet in the protective cowling and a tortuous air path from that inlet to the engine induction system. The tortuous air inlet path is designed so as to facilitate separation of water from the inlet air so the engine induction system and other engine components will be protected from water which may be drawn into the air inlet opening. However, the constructions of the type previously proposed for this purpose have provided such tortuous paths and restricted inlet openings that the efficiency of the engine induction system is deteriorated.

It is, therefore, a principal object of this invention to provide an improved cowling construction for an outboard motor.

It is another object of this invention to provide an improved air inlet system for the cowling of an outboard motor.

It is yet a further object of this invention to provide an outboard motor air inlet that will not significantly restrict air flow but which will at the same time prevent the ingress of water into the area around the engine.

As has been noted, certain prior art outboard motor cowlings provide rearwardly directed air inlets. Although such an arrangement may assist in preventing the ingress of water during forward travel of the boat, when the motor is tilted up and not in use it is possible for water to enter into the inlet opening and come into contact with the engine. For example, if the motor is tilted up when not in use and rain occurs, the rain can flow directly into the air inlet. Although a labyrinth or tortuous air path may be provided, the water can accumulate in the air inlet cavity provided in the outer cowling and enter into the engine area either when the engine is tilted up or when it is returned to its normal operating condition.

It is, therefore, a further object of this invention to provide a protective cowling for an outboard motor that will prevent the entry of water into the engine area under substantially all conditions.

It is a further object of this invention to provide a protective cowling arrangement for an outboard motor in which water is permitted to drain from the air inlet area regardless of the orientation of the motor.

The rearward facing air inlet of prior art protective cowlings has been defined in part by a recess in the rear portion of the main outer cowling member. This recess is covered by a cover plate and defines an air inlet cavity with the recess and an inlet to this cavity. When connecting the outer cowling members and cover plate together, it is important that the final construction provide a unitary appearing assembly and, nevertheless, one in which the air inlet function is efficiently and effectively provided.

It is, therefore, a further object of this invention to provide an improved cowling assembly for an outboard motor.

SUMMARY OF THE INVENTION

A first feature of this invention is adapted to be embodied in an air inlet system for an outboard motor or the like comprising an engine having an induction system and a protective cowling enclosing the engine and definine an air inlet cavity. An air inlet means is provided that communicates with the cavity for delivering air to it and air outlet means extend from the cavity and communicate with the engine induction system. A tortuous air path is defined between the inlet means and the outlet means for facilitating the separation of water from the air inducted into the engine. In accordance with this feature of the invention, the inlet means comprises at least one rearwardly facing inlet opening and at least one sidewardly facing inlet opening. The sidewardly facing inlet opening is related to the air inlet cavity so as to permit water to drain therefrom out through the sidewardly facing inlet opening when the motor is tilted up to prevent the accumulation of water in the air inlet cavity.

Another feature of this invention is adapted to be embodied in a protective cowling arrangement for an outboard motor or the like that comprises a first cowling member adapted to enclose a major portion of the engine and being defined with a recess at the rear portion thereof defined at least in part by a surface of the first cowling member. A second cowling member is affixed to the first cowling member and at least partially encloses the recess to define an air inlet cavity. The second cowling member is formed with a surface that is spaced from the surface of the first cowling member. In accordance with this feature of the invention, the surface of the first cowling member is formed with at least one air inlet opening that extends therethrough and which is surrounded in part by upstanding wall means. The wall means has an upper surface that is positioned to engage and support the surface of the second cowling member.

Yet another feature of the invention is adapted to be embodied in a protective cowling arrangement for the engine of an outboard motor or the like that comprises a first cowling member enclosing a major portion of the engine. The first cowling member defines a recess at the rear portion thereof by a vertically disposed wall extending downwardly from the upper surface thereof forwardly of its rear end and a horizontally disposed surface extending rearwardly from the vertically disposed wall. A second cowling member is affixed to the first cowling member and at least partially encloses the recess. The second cowling member has an upper surface that lies in substantially the same plane as the first cowling member upper surface and extends rearwardly from the vertically disposed wall and in spaced relation to the horizontally disposed surface of the first cowling member and substantially coextensive therewith. The second cowling member has downwardly extending portions that extend from the upper surface of the second cowling member and which are engaged with the horizontally disposed surface of the first cowling member and which define air inlet openings therebetween.

DETAILED DESCRIPTION OF THE PREFERRED EMBODIMENTS OF THE INVENTION

Figure 1:
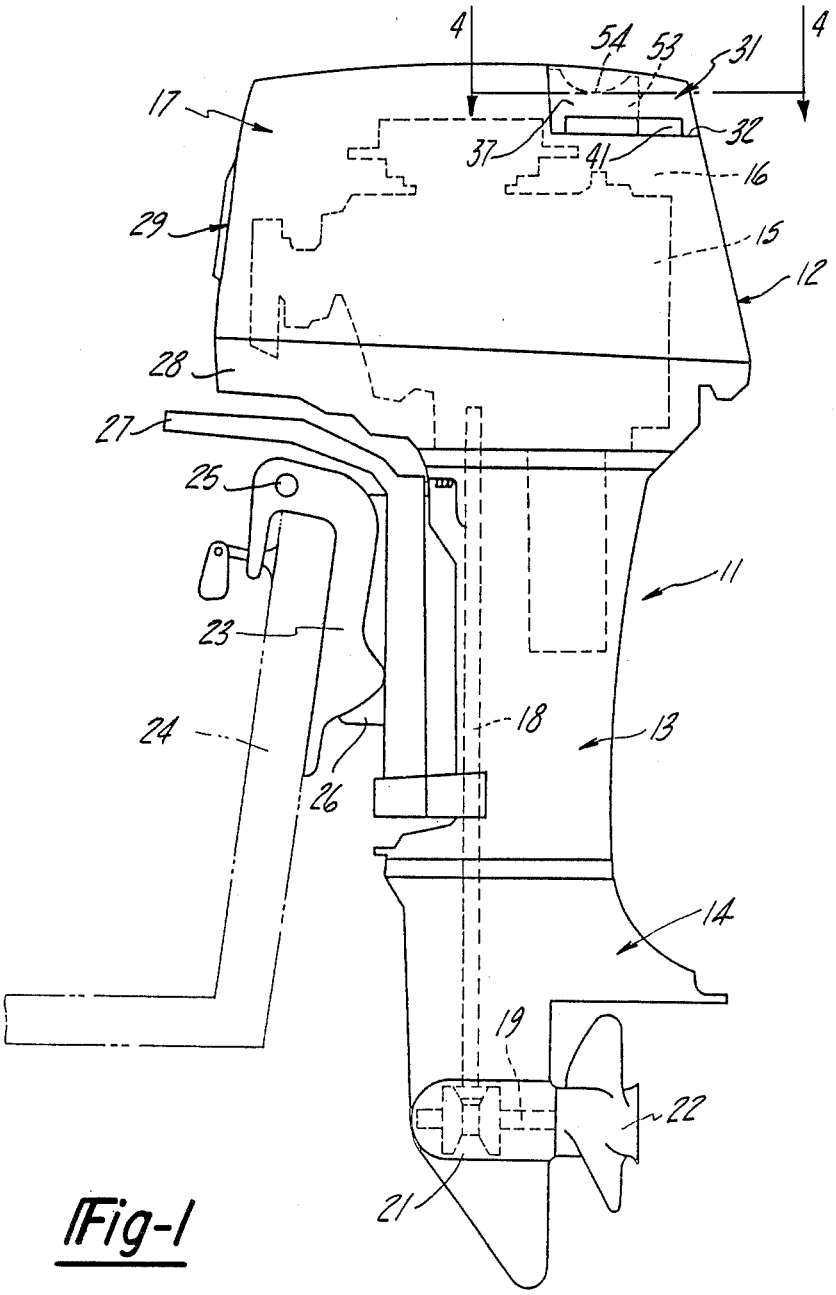
FIG. 1 is a side elevational view of an outboard motor constructed in accordance with this invention and attached to the transom of an associated boat.
Figure 2:
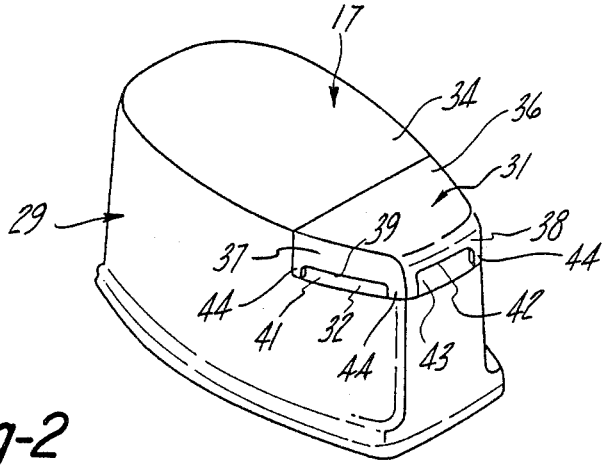
FIG. 2 is a perspective view, looking from above and the rear, of the protective cowling of the motor.
Figure 4:
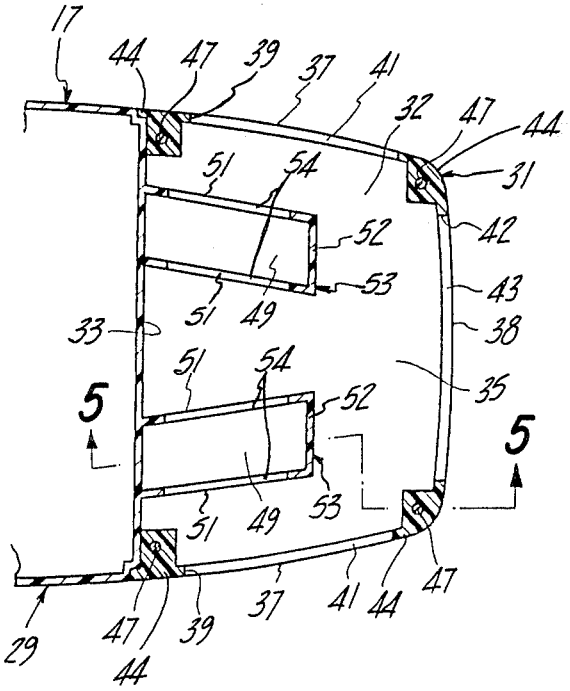
FIG. 4 is a enlarged, cross-sectional view taken generally along the line 4—4 of FIG. 1.
Figure 3:
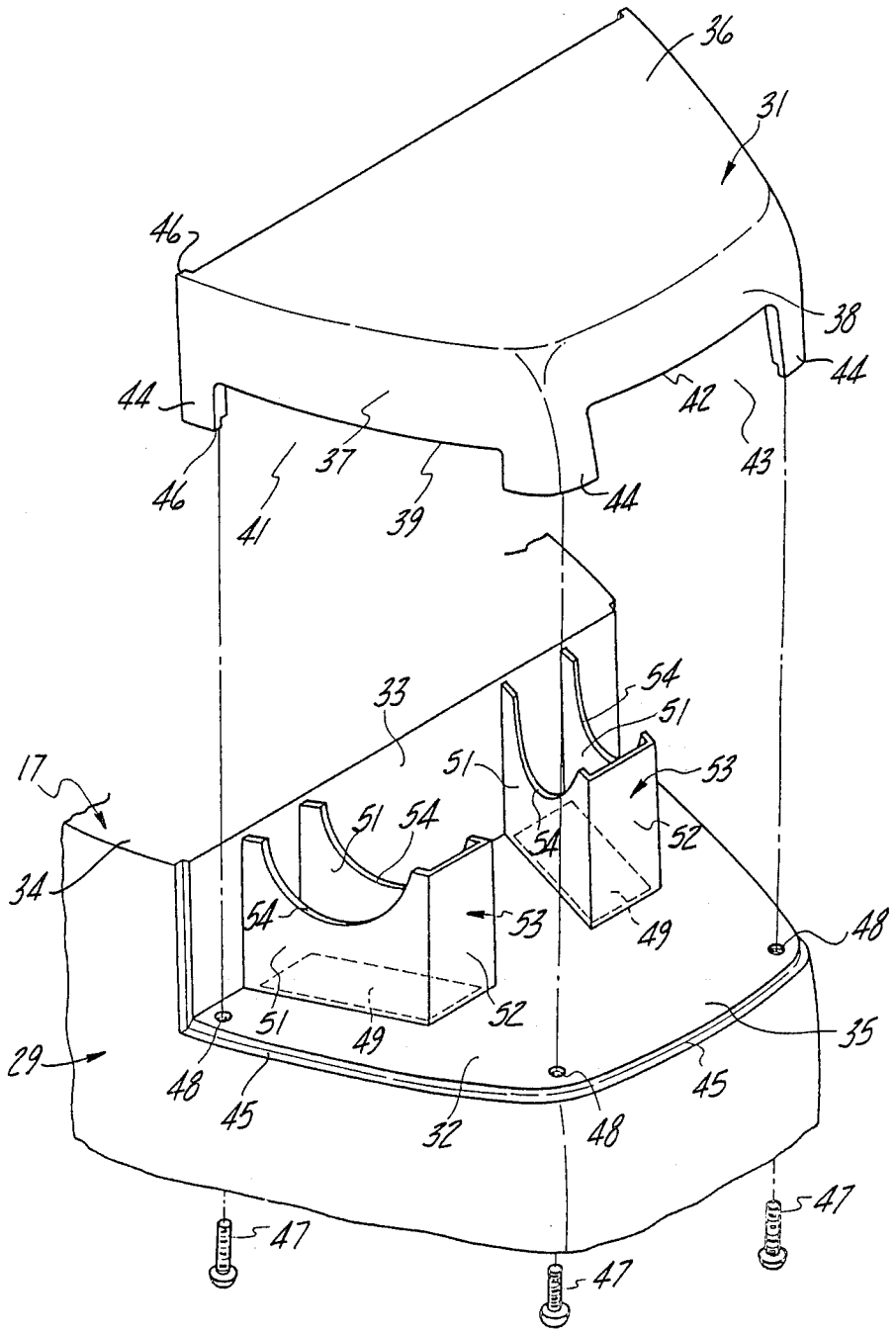
FIG. 3 is an enlarged, exploded view of the rear portion of the cowling as shown in FIG. 2.
Figure 5:
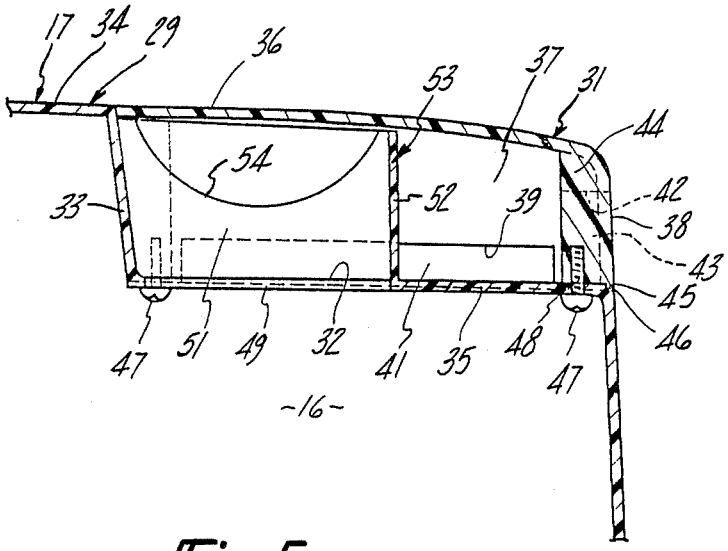
FIG. 5 is a cross-sectional view taken along the line 5—5 of FIG. 4.

Referring first to the embodiment of FIGS. 1-5 and specifically to FIG. 1, an outboard motor constructed in accordance with this invention is identified generally by the reference numeral 11. The motor 11 includes a power head 12, a drive shaft housing 13 and a lower unit 14. The power head 12 includes an internal combustion engine 15 of any suitable type which is contained within a cavity 16 defined by a protective cowling assembly, indicated generally by the reference numeral 17. The engine 15 drives a drive shaft 18 that extends vertically downwardly through the drive shaft housing 13 and which terminates in the lower unit 14. The drive shaft 18 drives a propeller shaft 19 through a forward/neutral/reverse transmission 21 of any known type so as to rotatably drive a propeller 22.

The motor assembly 11 includes a clamping bracket 23 that is used to detachably affix the motor 11 to a transom 24 of an associated watercraft in a known manner. The clamping bracket 23 is pivotally connected, by means of a pivot pin 25, to a swivel bracket 26 so that the motor 11 may be adjusted for trim and may be tilted up to an inoperative position. The drive shaft housing 13 is supported for steering movement relative to the swivel bracket 26 in a known manner and may be steered by means of a tiller 27.

The cowling assembly 17 includes a lower tray 28 and an upper cowling assembly consisting of a first cowling member, indicated generally by the reference numeral 29 and a second cowling member, indicated generally by the reference numeral 31. Referring now primarily to the FIGS. 2 through 5, the first cowling member 29 is formed with a recess 32 at its upper, rearward periphery. The recess 32 is defined by a generally vertically extending wall 33 that is formed at the rear edge of an upper surface 34 of the first cowling member 29. The rear wall 33 extends downwardly from the surface 34 and terminates at a generally horizontally disposed surface 35 which extends to the rearward periphery of the cowling member 29.

The second cowling member 31 is comprised of an upper surface 36 that lies in substantially the same plane as the first cowling member upper surface 34 so as to provide a uniform and continuous appearing surface when the parts are assembled together. The surface 34 of the second cowling member 31 is coextensive with the surface 35 of the first cowling member 29.

Side surfaces 37 and a rear surface 38 extend downwardly from the peripheral edges of the upper surface 36 and are substantially coextensive and in line with the side and rear surfaces of the first cowling member 29. The side surfaces 37 are formed with cutaway recesses 39 between their ends that define respective side air inlet openings 41. In a similar manner, the rear surfaces 38 is formed with a cutout portion 42 that defines a rear opening air inlet 43. The openings 41 and 43 are defined in part by generally thickened posts 44 at the four corners of the side and rear walls 37, 38. It should be noted that the front side of the cowling member 31 is generally open where it contacts the first cowling member vertically extending wall 33.

The portion of the first cowling member 29 surrounding the recess 32 is formed with a grooved edge 45. The lower ends of the post 44 are formed with tongues 46 that extend into the groove 45 so as to form a neat appearance and as well as to serve the purpose of interlocking these members together. The cowling member 31 is affixed to the cowling member 29 by means of a plurality of screws 47 that extend upwardly through apertures 48 formed in the cowling member surface 35 and which are threaded into tapped holes formed in the underside of the posts 44.

The lower wall 35 of the first cowling member 29 is formed with a pair of air outlet openings 49 for delivering air from the recess 32 to the interior cavity 16 of the cowling assembly 17. This air is adapted to be ingested into the induction system of the engine 15 in a known manner. Each of the openings 49 is surrounded by a pair of vertically extending side walls 51 that extend upwardly from the surface 35 and rearwardly from the vertically extending wall. The sidewalls 51 are joined integrally at their rear ends by means of a vertically extending rear wall 52 which also extends upwardly from the surface 35 and may be formed integrally with it. The walls 51 and 52 provide air outlet ducts 53 that extend upwardly a substantial distance above the surface 35 and upwardly beyond the upper termination of the air inlet openings 41 and 43.

The upper edges of the walls 51 and 52 extend into proximity to and engage the underside of the cowling member upper surface 36 so as to support and lend rigidity to this structure. In order to permit air to flow into the inlet ducts 53, therefore, the side walls 51 and 52 are formed with arcuate recesses 54.

In operation, when the engine 11 is in its operative position as shown in FIG. 1 and the engine is running, inlet air may be drawn freely through the inlet openings 41, 43 into the recess 32 in the area around the inlet ducts 35. The inlet air then can flow upwardly through the arcuate recesses 54 and be turned downwardly to flow through the air outlet openings 49 into the cavity 16 for ingestion into the engine 15. Because of the circuitous path of inlet air flow, any water carried by the inlet air as a result of either spray or rain will be separated. This separation is insured by the numerous turns that the inlet air must take before it passes through the openings 49. However, because a very large inlet air opening area is provided both in the outer area and through the cowling assembly 17 into the engine chamber 16, there will be no substantial restriction to air flow. The separated water may readily flow by gravity back out through the air inlet openings 41, 43.

As has been noted, the engine 11 may be tilted up about the pivot pin 25 when not in use. The rearwardly facing air inlet opening 43 gives the operator a hand grip whereby the motor 11 may be gripped and pulled up to its inoperative position. It should be noted, when the engine 11 is tilted up, the air inlet opening 43 will face in a generally upward direction. Therefore, if it rains, water may readily enter the cavity 32 through the inlet opening 43. However, this water will not pass into the engine compartment 16 since the rear walls 52 of the inlet ducts 53 are imperforate and extend up to and engage the underside of the cowling member 36. The water which thus enters will impinge upon the rear wall 33 and be redirected out of the inlet openings 41. Thus, water cannot accumulate in the recess 32 and pass into the interior of the protective cowling 17.

The upper cowling members 29 and 31 may be conveniently formed from a reinforced resin. Alternatively, any other materials well known for this purpose can be employed. However, the provision of the ducts 52 provides a stiffening in the rear area of the cowling and also cooperate with the upper cowling member 31 to add to its rigidity. Therefore, the cowling may be made of a lighter weight construction than as heretofore has been employed. In addition, the relatively large inlet area permits good ingestion of air for the engine 15 while at the same time assuring against the passage of water into proximity with the engine 15 where it could either enter its induction system or damage its electrical system. The prevention of such water accumulation is achieved under all running conditions and also when the engine is tilted up and not in use. It is to be understood, of course, that the shape and number of the inlet openings and discharge openings and duct shape can be changed.

In the embodiment of FIGS. 1 through 5, the rear wall 33 of the first cowling member 29 is disposed forwardly of the forwardmost peripheral edges of the openings 39. Therefore, there is a small area in which water might be able to accumulate when the motor was tilted up. Although the amount of water which may collect in this area is relatively negligible, an embodiment is shown in FIGS. 6 and 7 wherein no water collection is possible.

Figure 6:
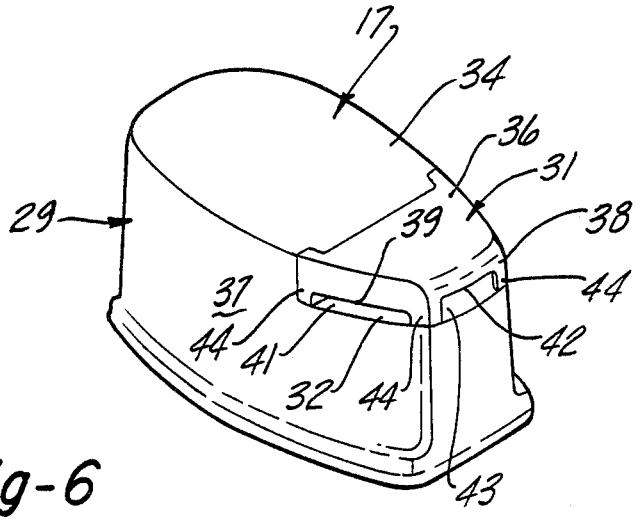
FIG. 6 is a perspective view, in part similar to FIG. 2, showing a protective cowling constructed in accordance with a further embodiment of this invention.
Figure 7:
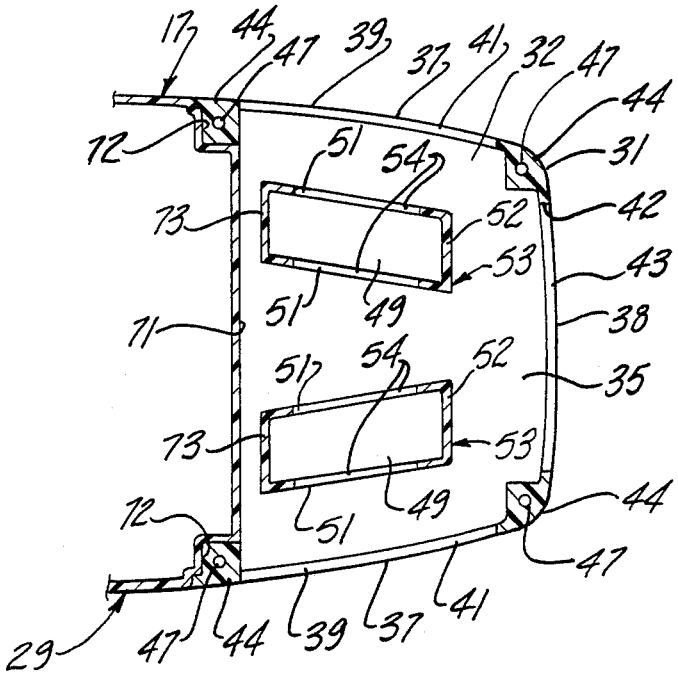
FIG. 7 is an enlarged cross-sectional view, in part similar to the cross-sectional view of FIG. 4, but showing the construction of the embodiment of FIG. 6.

The embodiment of FIGS. 6 and 7 is substantially the same as the embodiment of FIGS. 1 through 5 and, for that reason, components which are the same or substantially the same as the preceding embodiment have been identified by the same reference numeral. Where not necessary to understand the operation and construction of this embodiments, such similar components will not be described again in detail.

In this embodiment, the protective cowling member 29 is formed with a rear wall 71 that extends rearwardly from the termination of the side surfaces 37 of this member. The rear wall 71 is connected to the side surfaces 39 by recessed parts 72. The cowling member 31 has its corner post 44 formed complementary to the recesses 72 so that when the cowling part 31 is affixed to the cowling part 39, the forward edges of the openings 41 extend to the rear wall 71 of the cowling part 29. Therefore, there is no area in which water may be entrapped, even when the engine is tilted up. Said another way, the openings 41 extend forwardly to the forwardmost edge of the cavity 32 so that no water accumulation can be expected.

In this embodiment, the inlet ducts 53 are spaced rearwardly of the rear wall 71 and, accordingly, their forward ends are closed by upstanding walls 73.

The embodiment of these figures operate substantially the same as the embodiment of FIGS. 1 through 5 and the materials from which the cowling members are formed may be as aforedescribed.

Although two embodiments of the invention have been disclosed, various other changes and modifications may be made, without departing from the spirit and scope of the invention, as defined by the appended claims.

We claim:

1. An air inlet system for an outboard motor or the like comprising an engine having an induction system and a protective cowling enclosing said engine and defining an air inlet cavity exending transversely across the rear portion of said protective cowling from one side to the other, air inlet means to said cavity, air outlet means from said cavity and communicating with said engine induction system, and means defining a tortuous air path between said inlet means and said outlet means for facilitating the separation of water from the air inducted into said engine, the improvement comprising said inlet means comprising at least one rearwardly facing inlet opening into said air inlet cavity and at least one sidewardly facing inlet opening into said air inlet cavity at the lower periphery thereof when said motor is in a normal running condition so that water entering said air inlet cavity may drain from said sidewardly facing inlet opening, said sidewardly facing inlet opening extending to the forward periphery of said air inlet cavity.

2. An air inlet system as set forth in claim 1 wherein the sidewardly facing opening is related to said air inlet cavity to permit water to drain therefrom from said air inlet cavity when the motor is tilted up to prevent the accumulation of water therein.

3. An air inlet system as set forth in claim 1 wherein there are a pair of sidewardly facing inlet openings, one on each side of the engine.

4. An air inlet system as set forth in claim 1 wherein the protective cowling comprises a first member having a recess at its rearward end and defining the air inlet cavity and a second member affixed to said first member and covering said recess, the air inlet openings being formed in said second member.

5. An air inlet system as set forth in claim 4 wherein the air outlet means is defined by upstanding wall means formed on the first member and engaging the underside of the second member.

6. An air inlet system as set forth in claim 5 wherein the upstanding wall means is formed with a recess at its upper end for passing air from said air inlet cavity into said air outlet, said recess being positioned vertically above the uppermost periphery of the air inlet openings when the motor is in its normal condition.

7. An air inlet system as set forth in claim 6 wherein the forwardmost edge of the sidewardly facing opening extends to the forward periphery of the air inlet cavity.

8. An air inlet system as set forth in claim 7 wherein the first member upstanding wall means extends rearwardly of its respective side portions and is aligned with the forwardmost peripheral edges of the sidewardly facing inlet openings.

9. An air inlet system for an outboard motor or the like comprising an engine having an induction system and a protective cowling enclosing said engine and defining an air inlet cavity, air inlet means to said cavity, air outlet means from said cavity and communicating with said engine induction system, and means defining a tortuous air path between said inlet means and said outlet means for facilitating the separation of water from the air inducted into said engine, the improvement comprising said inlet means comprising at least one rearwardly facing inlet opening and at least a pair of sidewardly facing inlet openings, one on each side of the engine, the forwardmost ends of the sidewardly facing inlet openings extend to the forwardmost end of the air inlet cavity.

10. In a protective cowling arrangement for the engine of an outboard motor or the like comprising a first cowling member adapted to enclose a major portion of the engine and being defined with a recess at the upper rear portion thereof defined in part by a surface thereof, a second cowling member affixed to said first cowling member and at least partially enclosing said recess to define an air inlet cavity, said second cowling member having a surface spaced from said surface of said first cowling member, the improvement comprising said surface of said first cowling member being formed with at least one air outlet opening extending therethrough and surrounded in part by upstanding wall means, said wall means having upper surface portions engaging said surface of said second cowling member, said second cowling member being formed with a rearwardly opening air inlet and a sidewardly opening air inlet providing communication with said air inlet cavity, the motor being supported for tilting motion about a horizontally disposed axis, said sidewardly opening air inlet opening being disposed at substantially the lowest portion of said air inlet cavity when said motor is tilted up about said axis to an inoperative position.

11. In a protective cowling arrangement as set forth in claim 10 wherein there are a pair of air outlet openings each surrounded by upstanding wall means having portions engaging the surface of the second cowling member.

12. In a protective cowling arrangement as set forth in claim 10 wherein the forwardmost edge of the sidewardly facing opening extends to the forward periphery of the air inlet cavity.

13. In a protective cowling arrangement as set forth in claim 12 wherein the first member upstanding wall means extends rearwardly of its respective side portions and is aligned with the forwardmost peripheral edges of the sidewardly facing inlet openings.

14. A protective cowling arrangement for the engine of an outboard motor or the like comprising a first cowling member enclosing a major portion of the engine, said first cowling member defining a recess at the rear portion thereof by a vertically disposed wall extending downwardly from the upper surface thereof and forwardly of the rear end thereof and a horizontally disposed surface extending rearwardly from said vertically disposed wall, said recess extending transversely across the entire width of said first cowling member, and a second cowling member affixed to said first cowling member and at least in part enclosing said recess, said second cowling member having an upper surface lying in substantially the same plane as said first cowling member upper surface and extending rearwardly from said vertically disposed wall and in spaced relationship to said horizontally disposed surface and being substantially coextensive therewith, said second cowling member having spaced downwardly extending portions that extend from said upper surface and which are engaged with the horizontally disposed surface of said first cowling member and which define a plurality of air inlet openings therebetween, at least one of said air inlet openings being formed in the side of said cowling and at least one other of said air inlet openings being formed in the rear of said cowling.

15. A protective cowling arrangement as set forth in claim 14 further including air outlet means formed in said horizontally disposed surface of said first cowling member for delivering air from said recess to the interior of said first cowling member.

16. A protective cowling arrangement as set forth in claim 15 wherein the air outlet openings are defined by an upstanding wall, the upper periphery of which engages the upper surface of the second cowling member.

17. A protective cowling arrangement as set forth in claim 15 wherein the vertically disposed wall of the first cowling member is formed with a pair of recesses at its side edges, the second cowling member having a pair of downwardly extending portions disposed in the recesses wherein the air inlet openings having their forwardmost edges aligned with said vertically disposed wall.

* * * * *